US005302786A

United States Patent [19]

Rosen et al.

[11] Patent Number: 5,302,786

[45] Date of Patent: Apr. 12, 1994

[54] MOLDED CASE CIRCUIT BREAKER FOR REMOTE CONTROL OPERATIONS

[75] Inventors: James L. Rosen, West Hartford; Roger N. Castonguay, Terryville, both of Conn.

[73] Assignee: General Electric Company, New York, N.Y.

[21] Appl. No.: 962,814

[22] Filed: Oct. 19, 1992

[51] Int. Cl.[5] ..... H01H 5/00

[52] U.S. Cl. ..... 200/400; 200/401; 403/120

[58] Field of Search ..... 200/400, 401; 403/91, 403/120, 161

[56] References Cited

U.S. PATENT DOCUMENTS

| | | | |
|---|---|---|---|
| 3,171,920 | 3/1965 | Klein et al. | 200/92 |
| 3,184,679 | 6/1965 | Wobbe | 403/161 |
| 4,435,100 | 3/1984 | Cox | 403/161 |
| 4,736,174 | 4/1988 | Castonguay et al. | 335/167 |
| 4,789,848 | 12/1988 | Castonguay et al. | 335/167 |
| 4,806,893 | 2/1989 | Castonguay et al. | 335/20 |
| 4,864,263 | 9/1989 | Castonguay et al. | 335/167 |
| 5,059,933 | 10/1991 | Castonguay et al. | 335/167 |
| 5,152,226 | 10/1992 | Swilley | 403/161 |

*Primary Examiner*—Henry J. Recla
*Assistant Examiner*—David J. Walczak
*Attorney, Agent, or Firm*—Richard A. Menelly

[57] ABSTRACT

A molded case circuit breaker of the type containing an electronic trip unit to control an operating mechanism for automatically turning the circuit breaker contacts between ON and OFF conditions under overload conditions and a handle operator for same under quiescent conditions is designed for operation with a motor operator unit. The operating mechanism unit is structured to resist the high impact forces translated to the mechanism by the motor operator unit.

8 Claims, 4 Drawing Sheets

FIG. 4
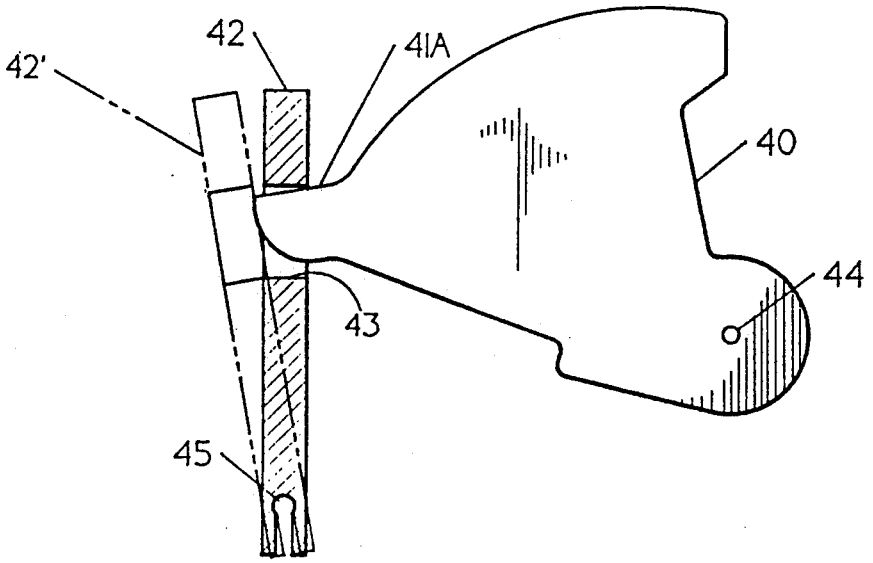
FIG. 5A
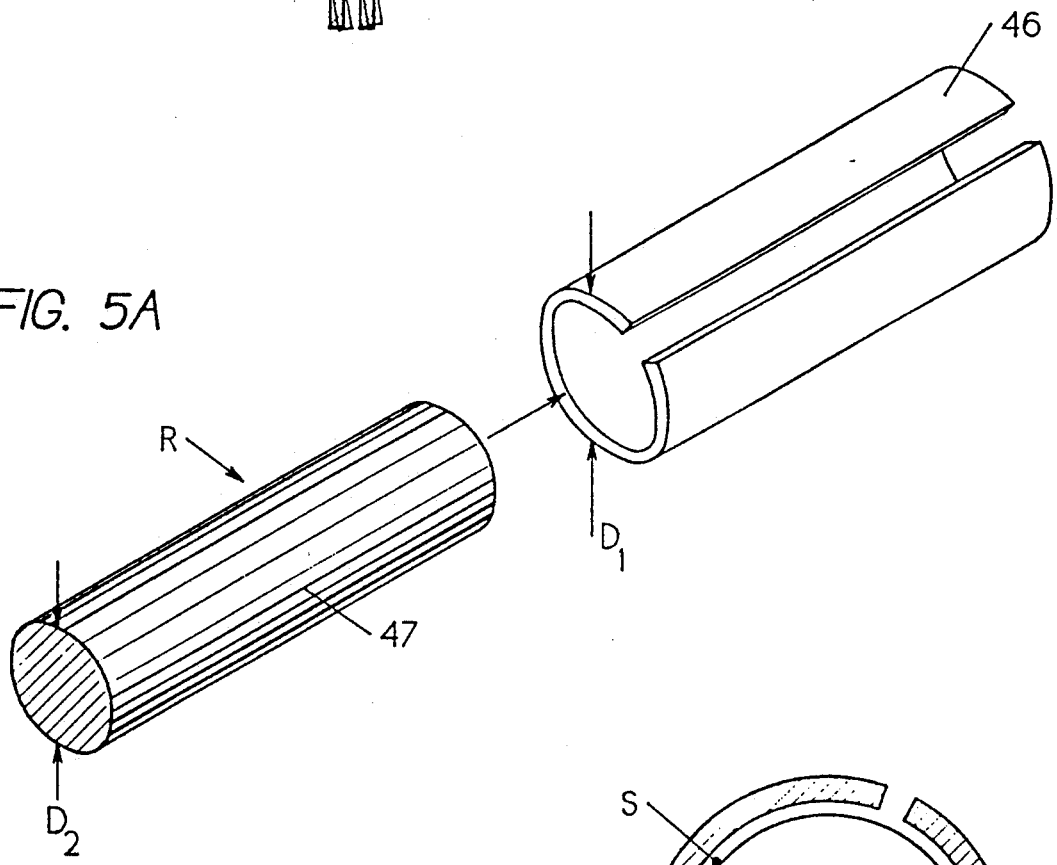
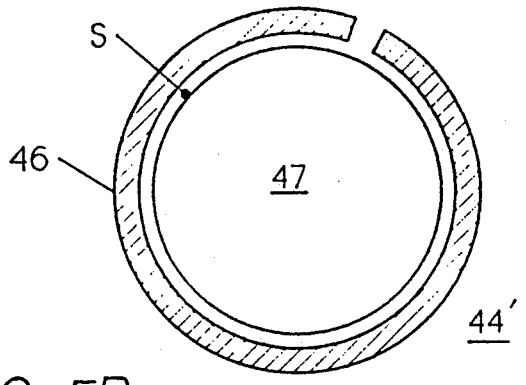
FIG. 5B

MOLDED CASE CIRCUIT BREAKER FOR REMOTE CONTROL OPERATIONS

BACKGROUND OF THE INVENTION

U.S. Pat. No. 4,806,893 entitled "Molded Case Circuit Breaker Actuator-Accessory Unit" describes the use of an electromagnetic actuator within an actuator-accessory unit to articulate a circuit breaker operating mechanism to separate the circuit breaker contacts upon the occurrence of an overcurrent condition of predetermined magnitude. An electronic trip unit in combination with current transformers are used within so-called "electronic trip" circuit breakers to sense the circuit current and determine when such a tripping function should be inputted to the actuator-accessory unit. The electronic trip unit and actuator-accessory unit replace prior art thermally and magnetically active trip elements which respond to changing circuit current in an analog fashion.

The operating mechanism and latch assembly used within the electronic trip circuit breakers are described in U.S. Pat. No. 4,736,174 entitled "Molded Case Circuit Breaker Operating Mechanism" and U.S. Pat. No. 4,864,263 entitled "Molded Case Circuit Breaker Latch and Operating Mechanism Assembly". The latch assembly within the operating mechanism is found within U.S. Pat. No. 4,789,848 and the cradle operator used within the operating mechanism is found within U.S. Pat. No. 5,059,933.

It has been determined that when the circuit breaker operating mechanism is articulated from a remote location by use of a motor operator, such as that described within U.S. Pat. No. 3,171,920 whereby a mechanical force is applied to the circuit breaker handle operator, the force transmitted to the operating mechanism is far in excess of that required for articulating the operating mechanism and substantially increases the rate at which the operating mechanism responds to drive the circuit breaker contacts between their ON-OFF conditions. The increased response rate could, in turn, adversely affect the life of the components within those operating mechanisms designed mainly for manual operation at a much slower response rate.

Accordingly, one purpose of the invention is to provide a circuit breaker operating mechanism that is capable of responding to the increased operating rates required with remote operating devices without affecting the life of the operating mechanism components absorbing huge impact forces without damage without substantial alteration to the existing operating mechanism design.

SUMMARY OF THE INVENTION

The operating cradle within a circuit breaker operating mechanism is provided with a shock-absorbing cradle pivot pin that attaches the cradle with the operating mechanism latching sideframe. The cradle pivot pin has an outer split cylinder of steel with an inner solid steel cylinder extending therein.

BRIEF DESCRIPTION OF THE DRAWINGS

FIG. 4 is an enlarged side view of the operating cradle within the impact-resistant operating mechanism of FIG. 2;

FIG. 5A is a front perspective view of the operating cradle pivot pin arrangement prior to assembly; and FIG. 5B is a side sectional view of the operating cradle pivot pin arrangement after assembly.

DESCRIPTION OF THE PREFERRED EMBODIMENT

Figure 1:
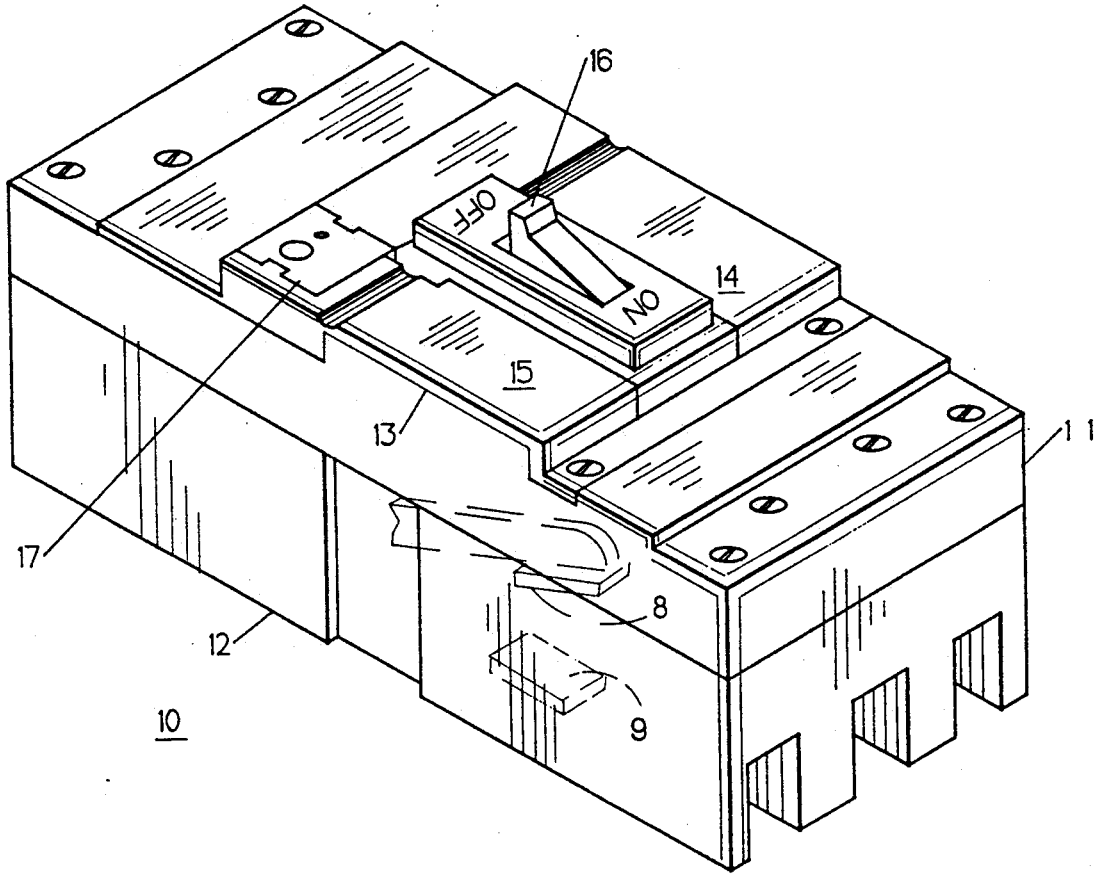
FIG. 1 is a top perspective view of a circuit breaker employing the impact-resistant operating mechanism in accordance with the invention.

An electronic trip circuit breaker 10 hereafter "circuit breaker" is depicted in FIG. 1 and consists of a molded plastic case 12 to which a molded plastic cover 11 is fixedly secured. An accessory cover 13 is attached to the circuit breaker cover and includes a pair of accessory doors 14, 15 for accessing the actuator-accessory unit contained within the circuit breaker cover and for accessing an auxiliary accessory such as an undervoltage release unit or auxiliary switch contained in a separate compartment within the circuit breaker cover. An operating handle 16 extends through the circuit breaker cover for turning the circuit breaker contacts 8, 9 between their closed and open positions. A rating plug 17 interconnects with the electronic trip unit to set the ampere rating of the circuit breaker.

Figure 2:
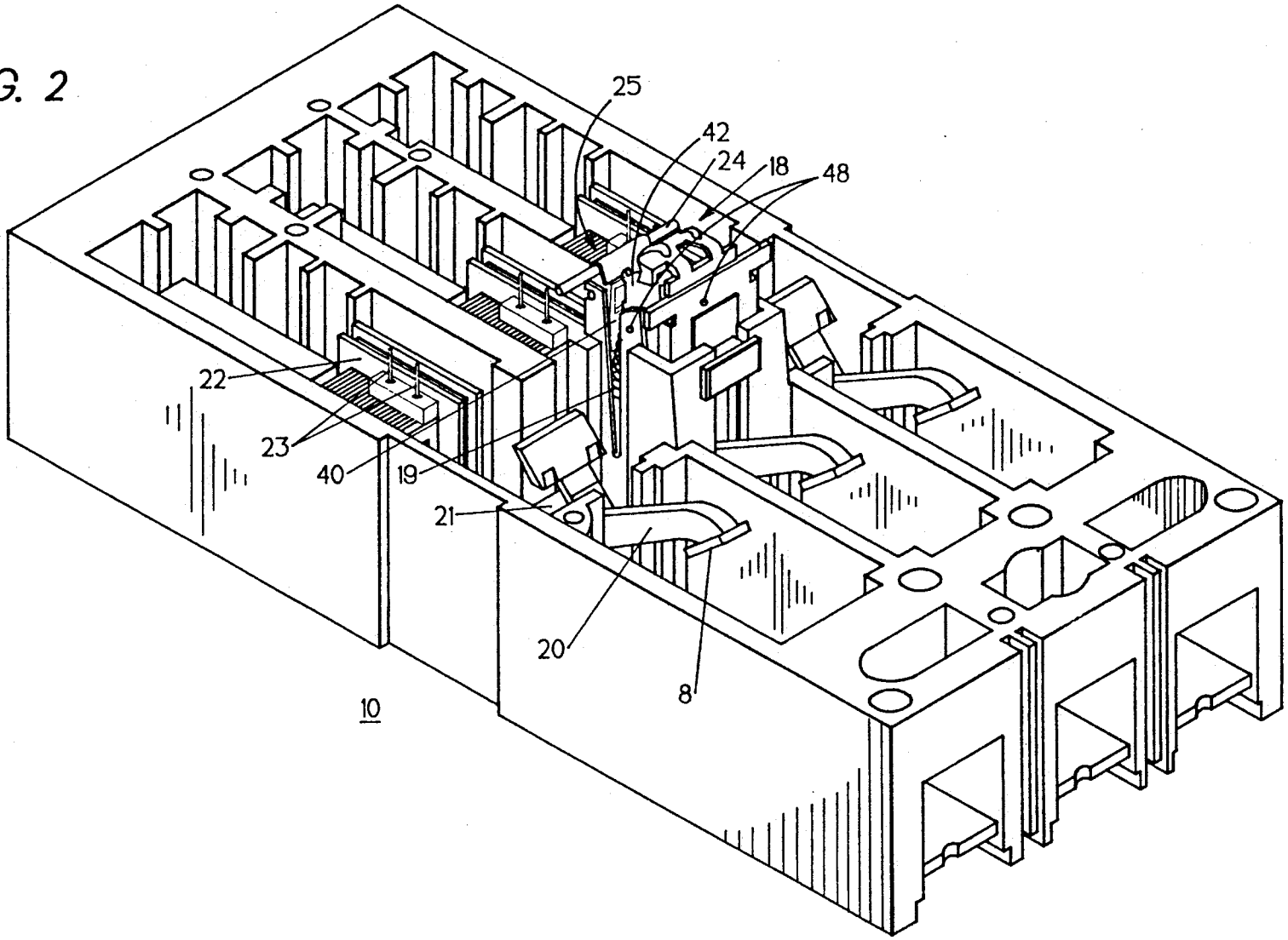
FIG. 2 is a top perspective view of the circuit breaker of FIG. 1 with the cover removed to depict the impact-resistant operating mechanism.

The circuit breaker 10 is depicted in FIG. 2 with the circuit breaker cover removed to show the circuit breaker operating mechanism 18 which includes a pair of powerful operating springs 19 to drive the movable contact arm 20 and the attached movable contact 8 to the open position indicated in FIG. 2. The operating cradle 40 is pivotally attached to the operating mechanism sideframe 48 and restrains the operating springs by engagement between the operating cradle and the latch plate 42 in the manner described within the aforementioned U.S. Pat. No. 4,789,848. Contacting the trip bar 24 attached to the latch assembly 25 allows the crossbar 21 and the associated movable contact arms 20 to be driven to the open or closed positions by articulating the circuit breaker operating mechanism. Three current transformers 22, one in each separate compartment, sense the circuit current and are electrically connected with the electronic trip unit contained within the circuit breaker cover by means of pin connectors 23.

Figure 3:
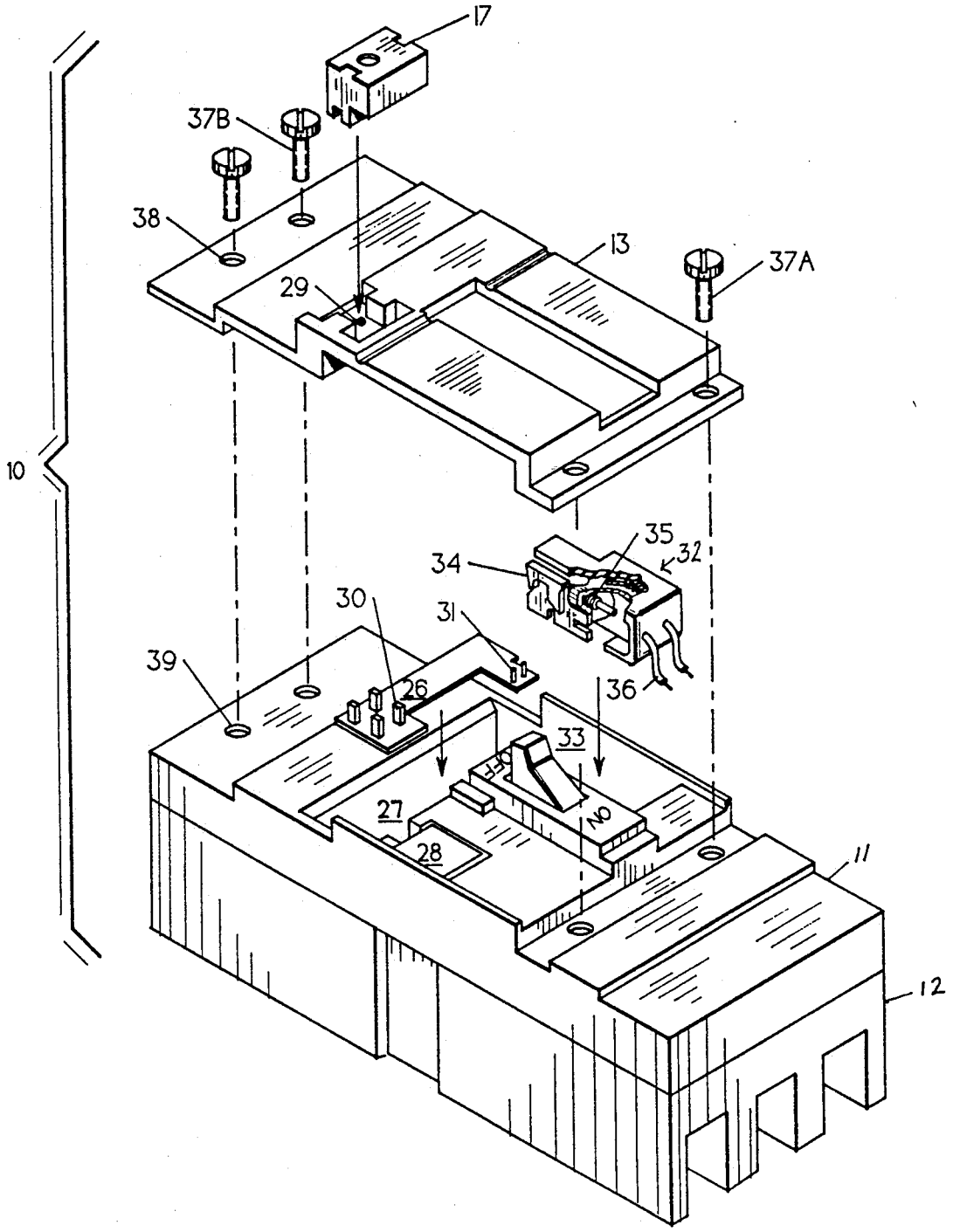
FIG. 3 is a top perspective view of the circuit breaker of FIG. 1 with the trip actuator assembly depicted in isometric projection.

The interaction between the actuator-accessory unit and the trip bar to unlatch the operating mechanism is best seen by referring now to FIG. 3, wherein the circuit breaker 10 is depicted with the cover 11 attached to the case 12 but prior to the attachment of the accessory cover 13 to the circuit breaker cover 11. The printed circuit board 26 containing the electronic trip unit is inserted within the corresponding trip unit recess 27 and the actuator-accessory unit 32 is inserted within the actuator-accessory recess 33. Electrical connection between the trip unit and the actuator-accessory unit is made by means of the pin connectors 31 upstanding from the trip unit. External electrical connection with the actuator-accessory unit for remote control function is achieved by means of a pair of conductors 36. The trip solenoid 35 controls the position of the actuator latch 34 which restrains the circuit breaker operating mechanism in a manner to be discussed below in greater detail. An accessory unit 28 is inserted within the circuit breaker cover before attachment of the accessory cover 13 by means of screws 37A, 37B, thru-holes 38 and threaded openings 39. The rating plug 17 is inserted within the rating plug recess 29 and electrically connects with the trip unit 26 by means of the pin connectors 30 upstanding from the trip unit.

The interaction between the operating cradle 40 and the latch plate 42 is best seen by referring now to FIG. 4. As described within the aforementioned U.S. Pat. No. 4,789,848, the operating cradle is pivotally attached to the sideframes by means of a cradle pivot which is attached to the sideframes in a press-fit relation and restrains the operating springs by means of the cradle hook 41A which sits within the slot 43 formed within the latch plate 42. Upon occurrence of an overcurrent condition, the latch plate rotates via the pivot 45 to the position indicated in phantom at 42' to thereby allow the cradle hook to release from the slot. When such an arrangement is subjected to the intense forces applied to the handle operator 16, shown in FIG. 1, these forces are transmitted along the sideframes, the cradle pivot pin 44 and the cradle hook 41A to the latch plate causing damage to the latch plate as well as to some of the other operating mechanism components.

In accordance with the teachings of this invention, an operating cradle pin arrangement 44' is depicted in FIGS. 5A,5B having shock absorbing facility whereby the forces transmitted from the handle operator are dissipated and thereby prevented from translating over to the latch plate. The cradle pin arrangement 44' includes a split hollow metal outer cylinder 46 of a predetermined interior diameter $D_1$ within which a solid metal inner cylinder 47 of a predetermined exterior diameter $D_2$ is inserted. The solid inner cylinder 47 is shaped to a radius of curvature R so as to define a slight bowing when inserted within the hollow outer cylinder 46 and to become trapped therein. The combination of the hollow outer cylinder and solid inner cylinder effectively dampens the applied forces because of the relative motion between the inner and outer cylinders within the slight space S existing between the inner surface of the outer cylinder and the outer surface of the inner cylinder.

Because the cradle pin arrangement of the invention has the ability to absorb high impact forces, the operating life of circuit breaker operating mechanism components is substantially increased. A high speed motor operator can accordingly be used with such circuit breakers utilizing the cradle pin arrangement without in any way affecting the operating life of the circuit breakers. The cradle pin arrangement of the invention has replaced the existing cradle pin 44 shown in FIG. 4 with only a slight cost increase and without requiring changes to any of the other operating mechanism components.

Having thus described our invention, what we claim as new and desire to secure by letters patent is:

1. A molded case circuit breaker comprising:

a plastic cover joined to a plastic case;

a pair of separable contacts within said case controlled by an operating mechanism;

a pair of opposing sideframes arranged within said case and supporting said operating mechanism;

a pair of springs within said operating mechanism arranged for driving said contacts between open and closed positions;

a handle operator extending external to said cover at one end and connecting with said operating mechanism at an opposite end, said handle operator moving said contacts between open and closed positions under quiescent current conditions;

a latch system coupled with said operating mechanism restraining said operating mechanism from separating said contacts until occurrence of an overcurrent condition of predetermined magnitude;

a cradle operator pivotally-arranged within said sideframes and removably connecting between said latch system and said operating mechanism, said cradle operator having a pivot end and an opposing latching end said latching end interacting with said latch system whereby said cradle operator releases from said latch system to allow said operating mechanism to separate said contacts upon occurrence of said overcurrent condition; and a cradle point pin pivotally attaching said cradle operator between said sideframes, said pivot pin including an inner and outer metal cylinder, said pivot pin outer cylinder comprising a split cylinder.

2. The circuit breaker of claim 1 wherein said latch system includes a latch plate having a cradle slot receiving said latching end of said cradle operator.

3. The circuit breaker of claim 1 wherein said pivot pin inner cylinder comprises a solid cylinder.

4. The circuit breaker of claim 1 wherein said pivot pin inner and outer cylinders are coextensive in length.

5. The circuit breaker of claim 1 wherein said outer cylinder defines a first predetermined diameter and said inner cylinder defines a second predetermined diameter, said second diameter being smaller than said first diameter.

6. The circuit breaker of claim 1 wherein said inner cylinder is arranged within said outer cylinder to thereby define a predetermined space between an outer surface on said inner cylinder and an inner surface on said outer cylinder.

7. The circuit breaker of claim 1 wherein said pivot pin is attached to said sideframes in a press-fit relation.

8. A molded case circuit breaker comprising:

a plastic cover joined to a plastic case;

a pair of separable contacts within said case controlled by an operating mechanism;

a pair of opposing sideframes arranged within said case and supporting said operating mechanism;

a pair of springs within said operating mechanism arranged for driving said contacts between open and closed positions;

a handle operator extending external to said cover at one end and connecting with said operating mechanism at an opposite end, said handle operator moving said contacts between open and closed positions under quiescent current conditions;

a latch system coupled with said operating mechanism restraining said operating mechanism from separating said contacts until occurrence of an overcurrent condition of predetermined magnitude;

a cradle operator pivotally-arranged within said sideframes and removably connecting between said latch system and said operating mechanism, said cradle operator having a pivot end and an opposing latching end said latching end interacting with said latch system whereby said cradle operator releases from said latch system to allow said operating mechanism to separate said contacts upon occurrence of said overcurrent condition; and a cradle pivot pin pivotally attaching said cradle operator between said sideframes, said pivot pin including an in inner and outer metal cylinder, said inner cylinder being bowed.

* * * * *